US009404483B2

(12) United States Patent
Kauss

(10) Patent No.: US 9,404,483 B2
(45) Date of Patent: Aug. 2, 2016

(54) HYDRAULIC CONTROL ARRANGEMENT

(75) Inventor: Wolfgang Kauss, Francheville (FR)

(73) Assignee: Robert Bosch GmbH, Stuttgart, DE (US)

( * ) Notice: Subject to any disclaimer, the term of this patent is extended or adjusted under 35 U.S.C. 154(b) by 924 days.

(21) Appl. No.: 13/582,081

(22) PCT Filed: Dec. 22, 2010

(86) PCT No.: PCT/EP2010/007883
§ 371 (c)(1),
(2), (4) Date: Nov. 13, 2012

(87) PCT Pub. No.: WO2011/107134
PCT Pub. Date: Sep. 9, 2011

(65) Prior Publication Data

US 2013/0213503 A1 Aug. 22, 2013

(30) Foreign Application Priority Data

Mar. 1, 2010 (DE) ..... 10 2010 009 705

(51) Int. Cl.
*F16D 31/02* (2006.01)
*F04B 23/00* (2006.01)
*F15B 11/16* (2006.01)

(52) U.S. Cl.
CPC ..... *F04B 23/00* (2013.01); *F15B 11/161* (2013.01); *F15B 2211/20553* (2013.01); *F15B 2211/605* (2013.01); *F15B 2211/78* (2013.01); *Y10T 137/86019* (2015.04)

(58) Field of Classification Search
CPC ..... F04B 23/00; F15B 11/161; F15B 11/165; F15B 2211/20553
USPC ..... 60/420, 422
See application file for complete search history.

(56) References Cited

U.S. PATENT DOCUMENTS

| | | | | |
|---|---|---|---|---|
| 4,343,151 | A * | 8/1982 | Lorimor | 60/422 |
| 5,333,449 | A * | 8/1994 | Takahashi et al. | 60/427 |
| 5,927,072 | A * | 7/1999 | Vannette | 60/452 |
| 7,430,859 | B2 * | 10/2008 | Jang et al. | 60/445 |
| 2005/0178116 | A1 * | 8/2005 | Olbrich | 60/420 |
| 2013/0220425 | A1 * | 8/2013 | Pomeroy et al. | 137/1 |

FOREIGN PATENT DOCUMENTS

| | | |
|---|---|---|
| DE | 28 00 814 A1 | 7/1979 |
| DE | 43 22 127 A1 | 1/1994 |
| DE | 44 17 962 A1 | 11/1995 |

OTHER PUBLICATIONS

International Search Report corresponding to PCT Application No. PCT/EP2010/007883, mailed Apr. 6, 2011 (German and English language document) (5 pages).

* cited by examiner

*Primary Examiner* — Nathaniel Wiehe
*Assistant Examiner* — Dustin T Nguyen
(74) *Attorney, Agent, or Firm* — Maginot, Moore & Beck LLP

(57) ABSTRACT

A hydraulic control arrangement includes a common variable displacement pump configured to supply pressure medium to two consumer groups. The pressure level of a control block assigned to one of the consumer groups is set to a different pressure level than that of a further control block assigned to the other consumer group.

4 Claims, 7 Drawing Sheets

HYDRAULIC CONTROL ARRANGEMENT

This application is a 35 U.S.C. §371 National Stage Application of PCT/EP2010/007883, filed on Dec. 22, 2010, which claims the benefit of priority to Serial No. DE 10 2010 009 705.5, filed on Mar. 1, 2010 in Germany, the disclosures of which are incorporated herein by reference in their entirety.

BACKGROUND

The disclosure relates to a hydraulic control arrangement for supplying pressure medium to two consumer groups.

To supply pressure medium to hydraulic consumers of mobile working appliances, such as, for example, excavators, tractors or dredger loaders, LS (load sensing) or throttle systems are often employed. In what are known as LS systems, the pump pressure is regulated as a function of the maximum load pressure of the consumers. So that the pressure medium volume flow to each consumer can be set independently of the load pressure, in what are known as LS control blocks each of the consumers is assigned an adjustable metering orifice and a pressure balance which keep the pressure medium volume flow constant independently of the load pressure. In what are known as LUDV systems, a subgroup of the LS systems, the pressure balance is acted upon in the closing direction by the maximum load pressure of all the consumers and in the opening direction by the pressure downstream of the metering orifice. In the event of undersaturation, in these LUDV systems the available volume flow is apportioned proportionally in the ratio of the opened metering orifice cross sections.

In LS systems, the pump delivery flow is therefore adapted to the respective requirements. In contrast to this, in a load pressure-dependent throttle system the pump always conveys the maximum possible or constant delivery rate. In this case, the pump may be designed as a fixed displacement or variable displacement pump. In these throttle controls, what are known as open-center control blocks are used, such as are described, for example, in data sheets RD 64 266 or RD 64 122 of Bosch Rexroth AG. These throttle control blocks have a multiplicity of directional valve elements which, in their basic position, route the pump volume flow via a bypass duct back to the tank with a low pressure loss. When a valve slide of a valve element is being adjusted, the connection to the assigned consumer is opened continuously while the pressure medium volume flow in the bypass duct is throttled, so that the pump pressure rises to the load pressure of the consumer.

When a plurality of consumers are activated via a throttle control block of this type, the volume flow to the individual consumers is apportioned as a function of the respective load pressure, the pressure medium preferably flowing to the consumer having the lowest load pressure. When a plurality of consumers are activated, in this case a pump pressure is set which corresponds approximately to the maximum load pressure of the consumers plus a predetermined pressure difference. The pump pressure therefore has to be throttled back correspondingly to actuate the consumer with the lowest load, and therefore considerable throttle losses arise.

As already mentioned, mobile working appliances, for example dredger loaders, are designed with control blocks of this type. A dredger loader has, for example, at its front a loading shovel and at its rear dredger equipment, so that the dredger loader combines the functions of a wheeled loader and those of a dredger. The front-side attachments and rear-side attachments are usually activated in each case via a control block, while for reasons of cost a throttle control block is often used for the dredger function and makes it possible at lower outlay to activate the attachment with relative sensitivity, but has the throttle losses mentioned.

A further problem is that the rear-side hydraulic consumers and the front-side hydraulic consumers are often operated at a different load pressure level, so that, in the case of a common pump, setting to the maximum load pressure is carried out and the load pressures to the other consumers have to be throttled back considerably.

DE 43 22 127 B4 discloses a hydraulic control engine with two control blocks, of which one is designed as an LS control block and a further control block is designed as a throttle control block with an open-center directional valve. Both the LS control block and the throttle control block are supplied with pressure medium from a common variable displacement pump which is activated as a function of the maximum load pressure of both control blocks, so that the pump pressure always lies above the maximum load pressure of the system by a predetermined pressure difference. In a basic position of the directional valve of the throttle control block, an LS control line branching off from a pump line carrying the pump pressure is relieved toward the tank via the open center of the directional valve, so that, by the directional valve being adjusted, the control oil volume flow is throttled and the control pressure communicated to the variable displacement pump rises correspondingly. The maximum control pressure at the throttle control block is limited via a pressure-limiting valve.

This solution basically has the same disadvantages as those explained above. When different consumer groups having a different load pressure level are activated, the variable displacement pump has to be regulated in terms of the maximum load pressure, and this high load pressure has to be throttled back at the control block having the lower load pressure level, the throttle losses being considerable.

By contrast, the object on which the disclosure is based is to provide a hydraulic control arrangement, by means of which two consumer groups with a different load level can be activated, along with reduced losses.

SUMMARY

This object is achieved by means of a hydraulic control arrangement having the features of the disclosure.

Advantageous developments of the disclosure are the subject matter of the subclaims.

According to the disclosure, the hydraulic control arrangement has a variable displacement pump, adjustable as a function of a load pressure or control pressure, for supplying pressure medium to two consumer groups to which a control block is assigned in each case, the control pressure picked off in one of the control blocks being limited by a pressure-limiting valve. According to the disclosure, a pressure-limiting valve, assigned to the other control block, is provided for limiting the control pressure level to a pressure different from the first pressure-limiting valve.

By the pressure-limiting valves being suitably set, the control pressure which prevails in the respective control block and may correspond to the maximum load pressure of the consumers activated by the control block can be limited to different levels, so that throttle losses in the control block having a lower control pressure level are limited. On account of this lower control pressure level, the losses are reduced considerably, as compared with the conventional solution, since only a limited control oil volume flow flows via the control block, this also being accompanied by an improvement in response behavior and controllability, particularly during mechanical actuation. By means of the control arrangement according to the disclosure, therefore, there is virtually a decoupling of the maximum control pressures in the two control blocks, this being without example in the prior art.

In a preferred exemplary embodiment of the disclosure, the control blocks are designed either identically or differently, basically throttle control blocks, LUDV control blocks or LS control blocks being capable of being used.

When a throttle control block is used, this is preferably designed in an open-center type of construction, and in the basic position the control line being connected to the tank in bypass.

In an exemplary embodiment of the disclosure, the control blocks are connected in series with their control lines, the load pressure in the control block adjacent to the variable displacement pump in the flow direction being limited to a higher value than the load pressure of the other control block.

In such a solution, the control lines are preferably connected to one another via a non-return valve which opens in the direction towards the downstream control block.

In an alternative solution, the control lines of the control blocks are connected in parallel.

In this case, it may be advantageous if the control line in a control block designed as a throttle control block is picked off via a flow-regulating valve from an inflow line carrying the pump pressure.

Advantageously, the control block having a lower control pressure level is designed as a throttle control block, and the control block having the higher control pressure level is designed as an LUDV or LS control block, there being provided downstream of said flow-regulating valve an LS switching valve which is acted upon in the closing direction by the control pressure in the other control block having the higher control pressure level and in the opening direction by the control pressure in the throttle block. By means of a design of this type, the control oil volume flow through the throttle block is switched off when the other, primary control block (LUDV, LS) operates at a higher control pressure level.

According to the disclosure, it is preferable if all the outflow lines issue in a tank line having a pressurizing valve, so that outflow to the tank takes place only at a pressure which lies above the tank pressure.

In a preferred exemplary embodiment of the disclosure, the control block having the higher control pressure level supplies a steering system via a priority valve.

In such a variant, it is preferable if the flow-regulating valve for limiting the control oil volume flow is arranged downstream of this priority valve.

The variable displacement pump is preferably activated as a function of the higher of the load/control pressures in the steering system, in the primary control block (higher control pressure level) or in the secondary control block (lower control pressure level).

BRIEF DESCRIPTION OF THE DRAWINGS

Preferred exemplary embodiments of the disclosure are explained in more detail below by means of diagrammatic drawings in which.

DETAILED DESCRIPTION

Figure 1A:
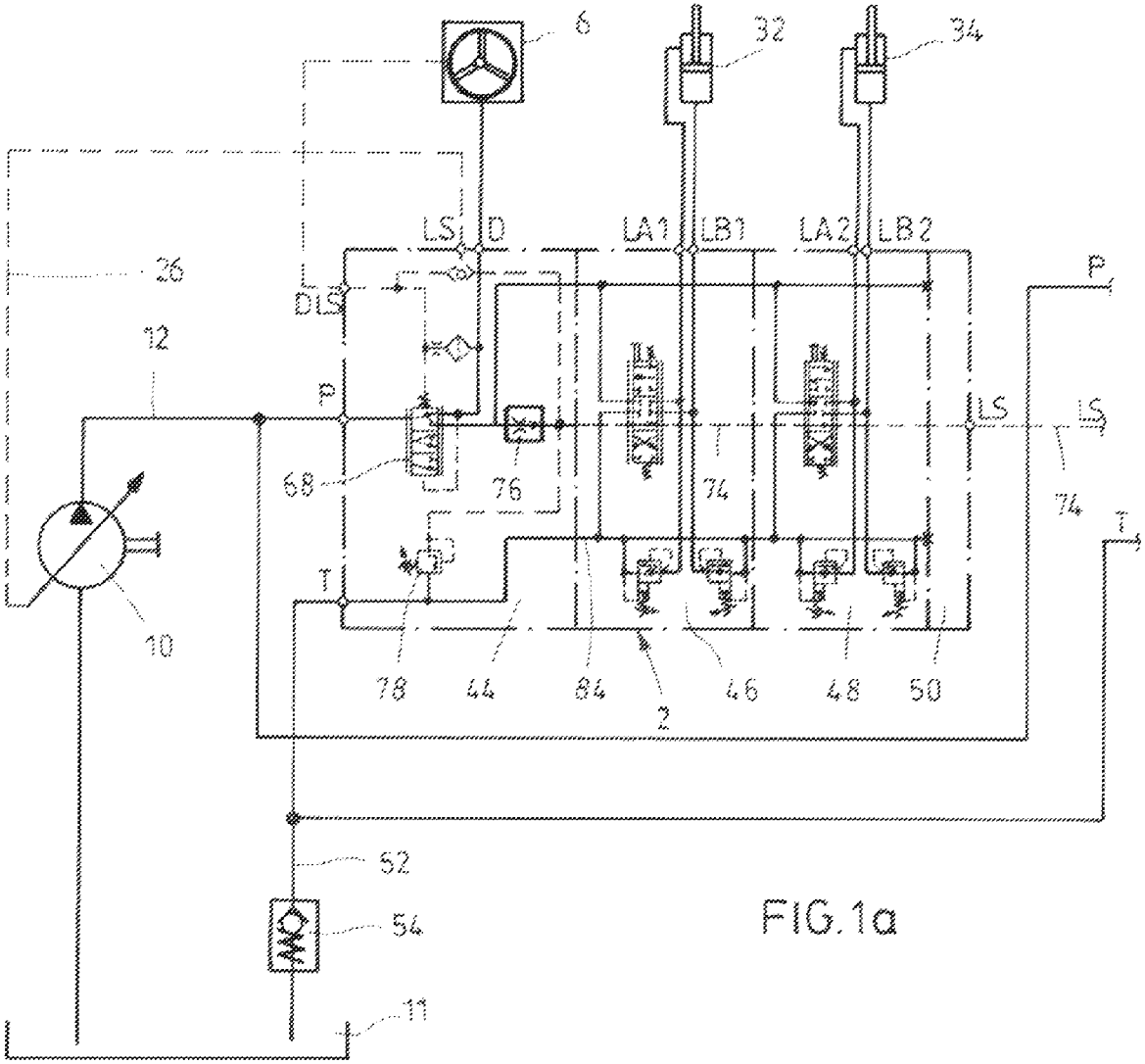
FIG. 1 shows a circuit diagram of a control arrangement of a dredger loader with two throttle control blocks.
Figure 1B:
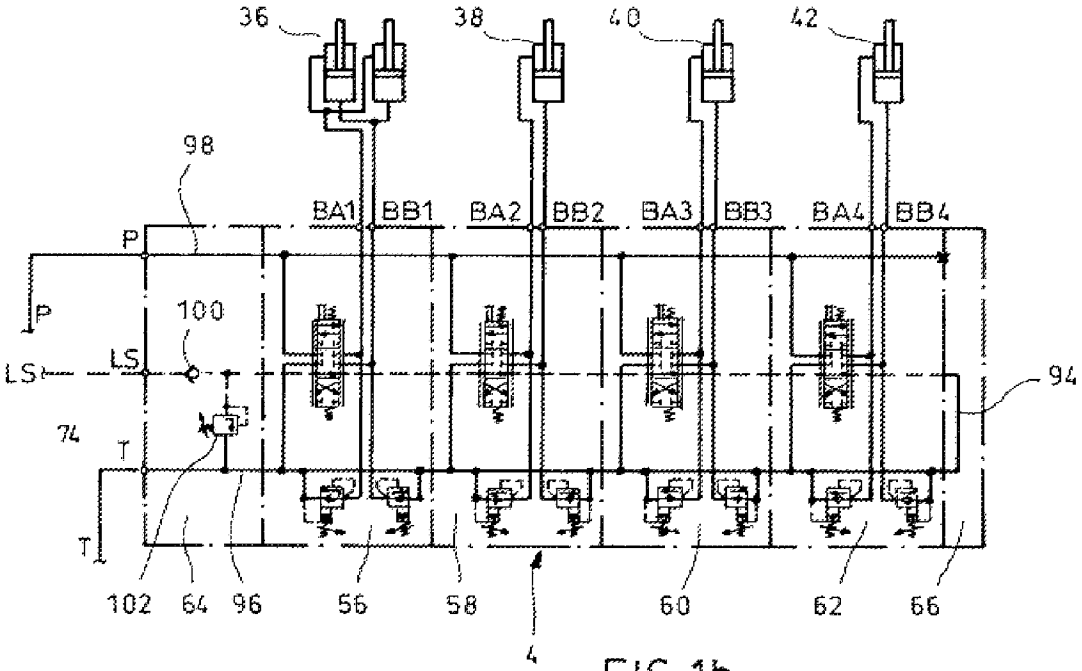

FIG. 1 shows a circuit diagram of a hydraulic control arrangement of a dredger loader which has a dredger appliance on the rear-side and a loading shovel on the front-side. To activate these items of equipment, the control arrangement is designed with two control blocks 2, 4, the latter being assigned to the rear-side dredger appliance and the control block 2 being assigned to the front-side loading shovel. A steering system 6 of the dredger loader is also supplied with pressure medium via this control block 2. The control arrangement has, furthermore, a variable displacement pump 10, illustrated merely diagrammatically in FIG. 1, which is set as a function of the maximum load pressure of the activated consumers such that the pump pressure lies above this maximum load pressure by the amount of a predetermined pressure difference.

Figure 2:
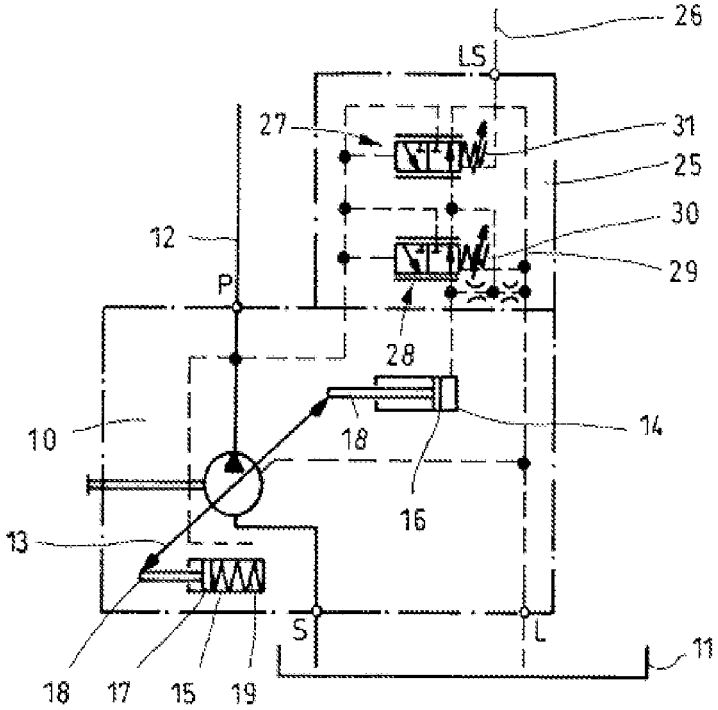
FIG. 2 shows a circuit diagram of a variable displacement pump for a control arrangement according to FIG. 1.

The basic set-up of a variable displacement pump 10 of this type is known per se from DE 199 30 618 A1 and is explained by means of FIG. 2. The variable displacement pump 10 can be designed, for example, as an axial piston pump which sucks in pressure medium from a tank 11 and conveys it into a pump line 12. A swash plate 13, indicated in FIG. 2 by a double arrow, can be pivoted by the interaction of two actuating cylinders 14, 15. The two actuating cylinders are differential cylinders which have a piston 16, 17 and in each case a piston rod 18 by means of which they engage on the swash plate 13. In each case only the piston rod-remote pressure space of the actuating cylinders 14, 15 is acted upon by the pressure. The piston surface of the piston 17 of the actuating cylinder 15 is smaller than the piston surface of the piston 16 of the other actuating cylinder. Extension of the piston rod 18 of the actuating cylinder 14 causes a reduction and extension of the piston rod 18 of the actuating cylinder 15 an increase in the pivot angle of the swash plate and consequently in the delivery volume of the variable displacement pump 10. In addition to the pressure in the actuating cylinder 15, a spring 19 exerts upon the swash plate 13 a force in the direction of an increase in the pivot angle.

The pressure space in the actuating cylinder 15 is constantly connected to the inflow line 12. The inflow and outflow of pressure medium to and from the pressure space of the actuating cylinder 14 is controlled by a pump-regulating unit 25 which is built onto the variable displacement pump 10 and which has a connection LS to which a load communication line 26 is connected. The pump-regulating unit 25 has an LS pump-regulating valve 27 and a pressure-regulating valve 28 which is set at a pressure lying above the load pressures usually occurring. The pressure-regulating valve 28 has a first connection which can be connected to the tank 11 via a relief line 29. A second connection of the pressure-regulating valve 28 lies on the pump line 12. A third connection, which can be connected to the first or to the second connection, is connected to the pressure space of the actuating cylinder 14. One connection of the LS pump-regulating valve 27 lies on the relief line 29 and a second connection lies on the inflow line 12. A third connection of the pump-regulating valve 27 can be connected to its first or second connection and is connected permanently to the first connection of the pressure-regulating valve 28. A slide of the pressure-regulating valve 28 is acted upon by a compression spring 30 with the effect of increasing the pivot angle and by the inflow pressure with the effect of reducing the pivot angle of the variable displacement pump 10. A slide of the LS pump-regulating valve 27 is acted upon with the effect of increasing the pivot angle of the variable displacement pump 10 by a compression spring and by the pressure prevailing in the load communication line 26 and with the effect of reducing the pivot angle by the inflow pressure. A force equilibrium prevails at the slide of the pump-regulating valve 27 when a difference corresponding to the force of the spring 31 is present between the inflow pressure and the pressure in the load communication line 26. This difference usually lies between 10 and 20 bar. Equilibrium prevails at the valve 28 when the inflow pressure generates a force which corresponds to the force of the spring 30. Usually, in the case of an equilibrium, the inflow pressure lies in the region of 350 bar.

The two control blocks 2, 4 are designed in each case as throttle control blocks. A lifting cylinder 32 and a shovel cylinder 34 of the front-side loading shovel are actuated, in addition to the steering system 6, via the control block 2. The front-side equipment with two parallel-connected pivoting cylinders 36, with a boom cylinder 38, with a dipper arm cylinder 40 and with a dipper cylinder 42 is activated via the further control block 4.

The control block 2 designed as a throttle control block is composed essentially of an input section 44 and of two essentially identically constructed direction valve sections 46, 48 and of an output section 50. Provided on this control block 2 are a tank connection T, a pressure connection P connected to the pump line 12, a load communication connection DLS carrying the load pressure of the steering system 6, an LS connection connected to the load communication line 26, a working connection D connected to the steering system 6, two working connections LA1, LB1 connected to the lifting cylinder 32, two working connections LA2, LB2 connected to the shovel cylinders 34 and a further LS connection.

The tank connection T is connected to the tank 11 via a tank duct 52. Provided in the tank line 52 is a pressurizing valve 54 which opens the pressure medium connection to the tank 11 when the pressure prevailing in the tank line 52 is higher than the equivalent of a closing spring of the pressurizing valve 54.

The control block 4 which is assigned to the rear-side dredger appliance has four directional valve sections 56, 58, 60, 62, the set-up of which corresponds to the directional valve sections 46, 48 of the control block 2. Furthermore, the control block 4 is designed with an input section 64 and an output section 66. The input section 64 has formed on it a pressure connection P connected to the pump line 12, a further LS connection connected to the LS connection of the control block 2 and a tank connection T connected to the tank duct 52.

The two control blocks 2, 4 are thus connected in parallel in terms of the supply of pressure medium via the pump line 12, whereas they are connected in series via the two connections LS-LS in terms of a control line carrying the load pressure or a corresponding pressure. This is made even clearer by means of the following depictions.

Figure 3:
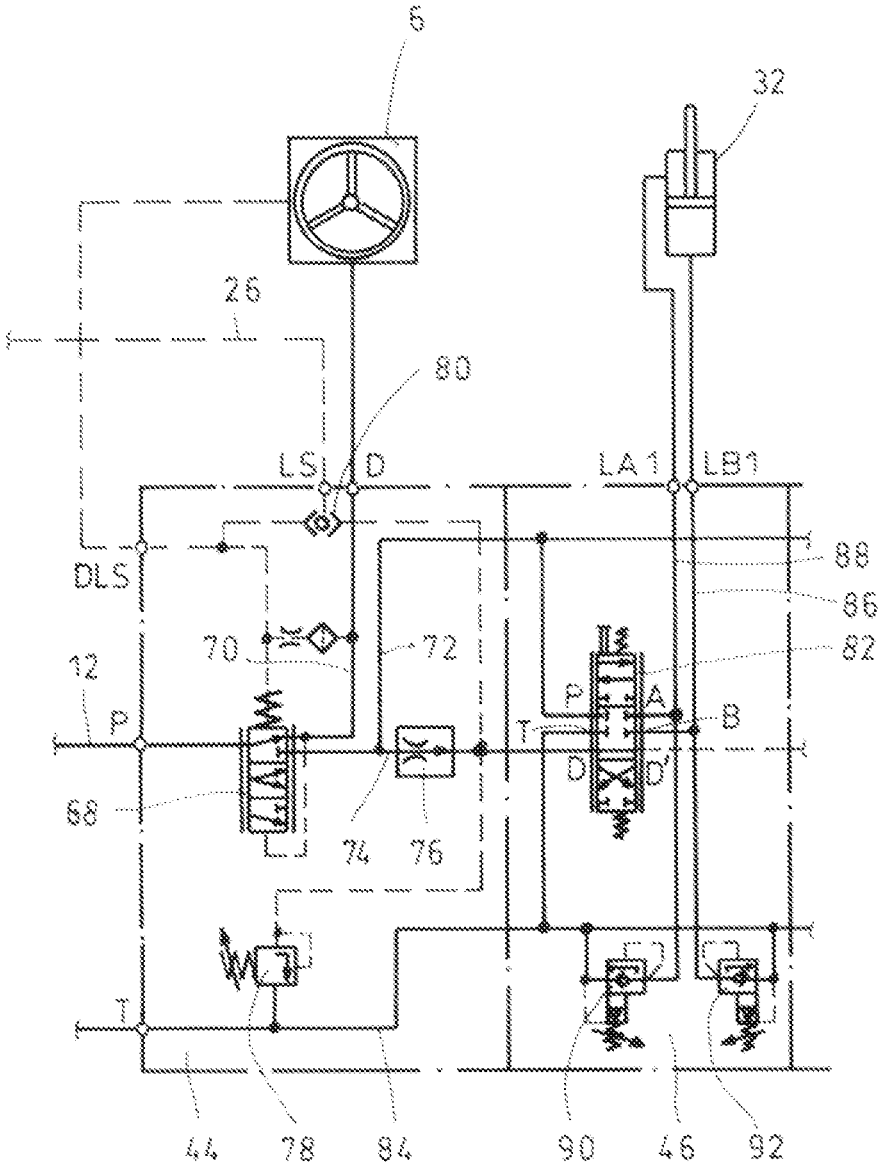
FIG. 3 shows an enlarged partial illustration of a directional valve section of a control block from FIG. 1.

FIG. 3 shows an enlarged illustration of the input section 44 and of the directional valve section 46. As already mentioned, the pump line 12 issues in the pressure connection P of the input section 54 and is connected at the input of a priority valve 68. The latter is prestressed via a spring and via the load pressure prevailing at the steering system 6 and is picked off by the connection DLS into a basic position in which the pump line 12 is connected via a steering duct 70 to the working connection D to which the steering system 6 is connected. The pressure in the steering duct 70 acts in the opposite direction on a slide of the priority valve 68, so that, with rising pressure in this steering duct 70, the priority valve is displaced into a position in which a pressure medium connection to an inflow duct 72 is opened. In the event that the steering system 6 requires no pressure medium, the priority valve 68 is adjusted by the pressure in the steering duct 70 such that the pressure medium connection to the steering duct 70 is closed completely, so that the pressure medium flows via the priority valve 68 into the inflow duct 72.

A control line 74 branches off from the inflow duct 72 and has provided in it a flow-regulating valve 76, via which a control oil volume flow is branched off from the inflow duct 72. The pressure downstream of the flow-regulating valve 76 is limited to a predetermined control pressure level via a pressure-limiting valve 78. The output of the pressure-limiting valve 78 issues in an outflow duct 72 which is connected to the tank connection T of the input section 44 and is therefore connected to the tank line 52.

The pressure downstream of the flow-regulating valve 76 is communicated to the input of a shuttle valve 80. The other input connection of the latter is acted upon by the pressure at the connection DLS, so that the higher of these pressures is communicated via the LS connection in the LS line 26 and the variable displacement pump 10 is adjusted as a function of this pressure.

The directional valve section 46 has an open-center directional valve 82 which, as illustrated, can be adjusted by hand or else hydraulically or electrohydraulically. The basic set-up of the directional valve 82 is described in the initially mentioned data sheets RD 64 266 or RD 64 122, and therefore reference is made for details toward the relevant statements and only the structural elements essential for understanding the disclosure are explained here.

The OC directional valve 82 has a pressure connection P connected to the inflow duct 72, a tank connection T connected to the outflow duct 84, a control connection D connected to the control line 74, two output connections A, B which are connected to the working connections LA1, LB1, and also a control output D' which issues in a further portion of the control line 74 which passes through both control blocks 2, 4 according to FIG. 1. For the sake of clarity, separate reference symbols have not been given to the individual portions of the control line 74 upstream and downstream of the individual valves.

In the spring-prestressed basic position illustrated, the connections P, T, A, B of the OC directional valve 82 are shut off, however, the control oil connections D, D' are connected to one another, so that the control oil can flow essentially pressurelessly through the directional valve 82. The two working connections A, B of the OC directional valve 82 are connected to the working connections LA1, LB1 via working ducts 86, 88. These working ducts 86, 88 act as a forward flow line or return flow line, depending on the adjustment of the OC directional valve 82.

Provided in each case in each of the working ducts 86, 88 is a combined aftersuction/pressure limiting valve 90, 92, via which, on the one hand, the pressure in the working lines 88, 86 is limited and, on the other hand, in the event of a pulling load, pressure medium can be aftersucked from the tank 11 into the enlarging pressure space.

When the directional the valve 82 is adjusted in one of the two directions illustrated in FIG. 3, this control oil connection is closed and the control oil volume flow is correspondingly throttled, the pressure medium connection from the pressure connection P to one of the working connections A, B is opened and the outflow from the reducing pressure space is correspondingly opened to the tank connection T of the OC directional valve 82 via the other of the two working connections A, B. An OC directional valve 82 of this type allows highly accurate activation of the connected hydraulic consumers, the set-up being very simple, although the disadvantage is that the control oil volume flow has to be throttled so that the respective hydraulic consumer can be activated.

The other directional valve sections 56, 58, 60, 62 of the control blocks 2, 4 have the same set-up as the directional valve section 46 described by means of FIG. 3, and therefore further explanations are unnecessary.

According to FIG. 1, the control line 74 is connected to the LS connection of the input section 64 of the control block 4, so that this control line 74 is also continued in the control block 4. In the output section 66 of the control block 4, a deflection 94 is provided, via which the control line 74 is connected to an outflow line 96 which is common to all the sections 64, 56, 58, 60, 62 and which is connected to the tank line 52 via the tank connection T of the input section 64. The pump line 12 is connected to the pressure connection P of the input section 64 and issues in an inflow line 98 common to all the sections of the control block 4. Arranged within the input section 64, in the control line 74, is a non-return valve 100 which permits a control oil flow to the directional valve sections 56, 58, 60, 62 and shuts off said flow in the opposite direction. The non-return valve 100 permits a control oil flow to the control block 4 when the control pressure/load pressure in the region of the control block 2 is higher than in the control block 4.

The pressure downstream of the non-return valve 100 is limited via a further pressure-limiting valve 102 to a pressure level which lies below the pressure level limited via the pressure-limiting valve 78. In the illustrated basic position of the OC directional valves 82 of the directional valve sections 46, 48, 56, 58, 60, 62, the control oil flows through all the OC directional valves 82 virtually pressurelessly to the tank 11 in bypass.

By the pressure level being limited via the pressure-limiting valve 102 in the input section 64, the control oil volume flow is limited via the bypass edges of the directional valves 82 of the control block 4 and therefore the throttle losses are reduced. That is to say, via the two pressure-limiting valves 78, 102, the load pressure level of each control block 2, 4 is limited to a level which is optimal in terms of minimizing the control oil throttle losses, the pressure level in the control block 4 lying below that of the control block 2.

The control/load pressure which is set in the control line 74, depending on the activation of the consumers 32, 34, 36, 38, 40, 42, is then compared with the load pressure of the steering system 6 and in each case the higher load pressure in the load communication line 26 is communicated, so that the pump pressure is then regulated above this maximum load pressure by the amount of the predetermined pressure difference.

The OC directional valves 82 used in the exemplary embodiment according to FIG. 1 make it possible at minimal outlay to activate the individual hydraulic consumers with very high sensitivity, although, as before, there are throttle losses. In order to minimize these even further, instead of one of or the throttle control blocks 2, 4, another control block, for example an LUDV control block, may also be used. An exemplary embodiment of this type is explained by means of FIG. 4.

In this exemplary embodiment, activation of the hydraulic consumers of the dredger appliance likewise takes place again via a throttle control block 4 which differs merely in the set-up of the input section 64 from the exemplary embodiment according to FIG. 1, and therefore only the differences are explained below. The control block assigned to the loading shovel is designed as an LUDV control block 2' with an input section 104 and two identically constructed LUDV sections 106, 108 and also a closing plate 110. The variable displacement pump 10 has the same set-up as in the exemplary embodiment described above.

Figure 5:
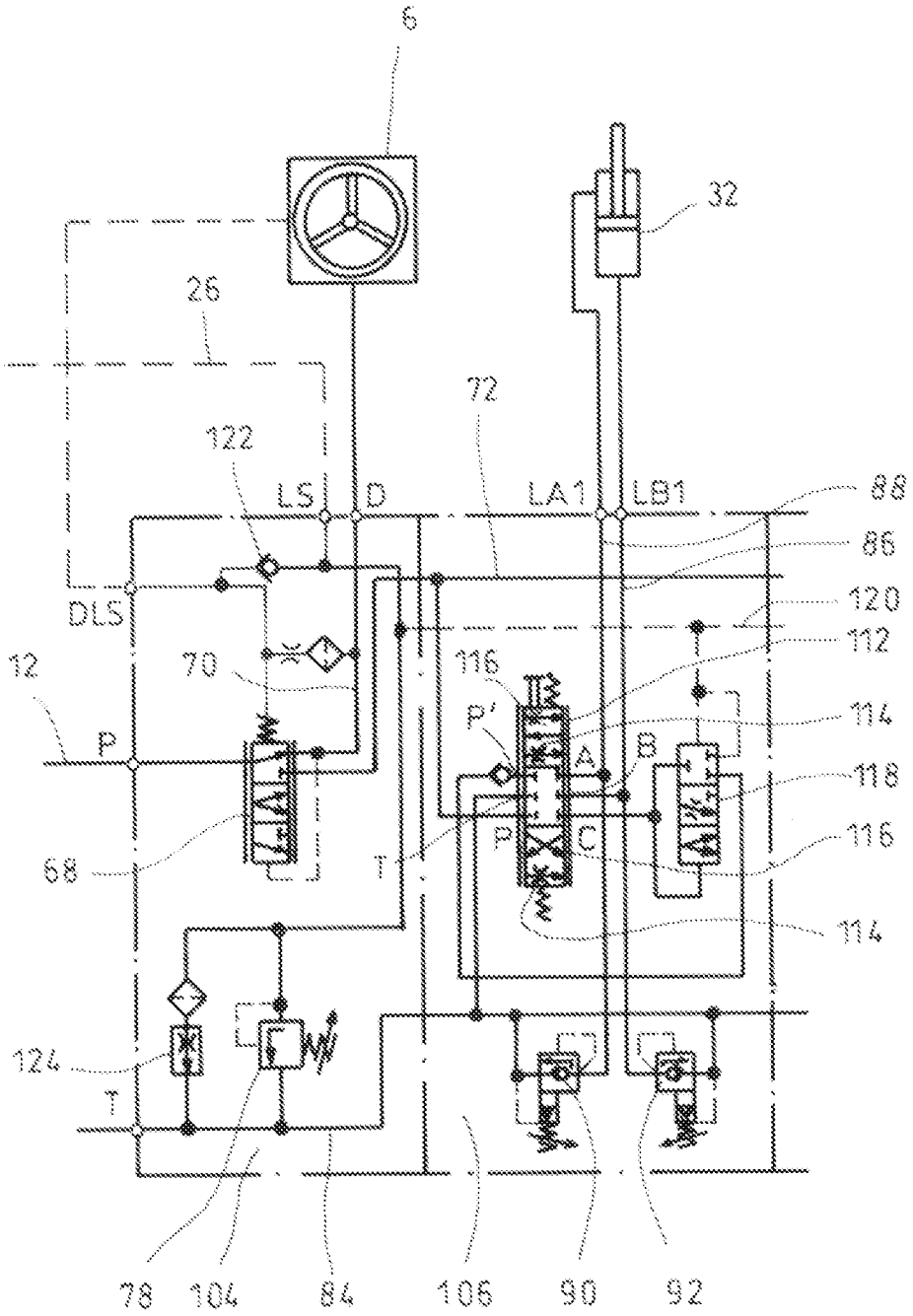
FIG. 5 shows a partial illustration of the LUDV control block from FIG. 2.

The set-up of the LUDV control block 2' is explained by means of FIG. 5. The steering system 6 is supplied in the same way as in the exemplary embodiment described above via a priority valve 68 which is acted upon with the effect of supplying pressure medium to the steering system 6 by the steering load pressure prevailing at the connection DLS and with the effect of supplying pressure medium to the LUDV sections 106, 108 by the pressure downstream of the priority valve 68, that is to say by the pressure in the steering duct 70. As in the exemplary embodiment described above, a second output connection of the priority valve 68 has connected to it the inflow duct 72, via which the pressure medium flows to the LUDV sections 106, 108.

The LUDV section 106 has a set-up, as described in the initially mentioned DE 199 30 618 A1 or in data sheet RD 64 122 of Bosch Rexroth AG. An LUDV section 106 of this type has a continuously adjustable LUDV directional valve 112 which has a velocity part, formed by a metering orifice 114, and a direction part 116, via which the pressure medium flow direction to and from the assigned consumer, here the lifting cylinder 32, is determined.

A pressure connection P of the directional valve 112 is connected to the inflow duct 72. An outflow connection T is in pressure medium connection with the outflow duct 84 connected to the tank connection T, two output connections A, B are connected to the two working connections LA1, LB1 via the working ducts 86, 88, a pressure balance connection C is connected to the input of an LUDV pressure balance 118 which is acted upon in the closing direction by the pressure in a load communication line 120 and in the direction of an increase in a throttle cross section by the pressure at the pressure balance connection C, that is to say by the pressure downstream of the metering orifice 114. With the LUDV pressure balance opened completely, the pressure downstream of the metering orifice 114 in the load communication line 120 is communicated.

Via this LUDV pressure balance 118, the pressure drop across the metering orifice 114 is kept constant independently of the load pressure and the maximum load pressure prevailing at the input of the LUDV pressure balance 118 is throttled back to the individual load pressure. The pressure medium throttled back to the individual load pressure then flows from the output of the pressure balance 118 via a connection P' of the LUDV directional valve 112 and the direction part 116 and the corresponding working duct 86, 88 into the enlarging pressure space of the lifting cylinder 32 and flows out from the reducing pressure space via the corresponding working line 88, 86, the direction part 116 and the outflow duct 84 to the tank 11. As in the exemplary embodiment described above, in each case a combined after suction/pressure-limiting valve 90, 92 is arranged in the working ducts 86, 88.

The load communication line 120 is connected to the LS connection of the input section 104 and is connected via a further non-return valve 122 to the connection DLS carrying the steering load pressure. In the event that the load pressure of the steering system 6 is higher than the load pressure in the load communication line 120, the non-return valve 122 opens, so that the steering load pressure is then communicated in the LS line 26. With the non-return valve 122 closed, the pressure in the load communication line 120 also prevails on the LS line 26. The pressure in the load communication line 120 is again limited via a pressure-limiting valve 78 to a pressure level which lies above the pressure level of the throttle control block 4. In the exemplary embodiment according to FIG. 4, in parallel with the pressure-limiting valve 78, a small flow-regulating valve 124 is provided, via which a continuous control oil volume flow to the outflow duct 84 is made possible.

As in the exemplary embodiment described above, the supply of pressure medium to the throttle control block 4 takes place via the pump line 12 which is connected to the connection P of the input section 64. The load pressure in the LS line 26 also prevails at the connection LS of the input section 64. The outflow connection T of the input section 64 is in pressure medium connection with the tank duct 52.

Within the throttle control block 4, an inflow line 98 for supplying pressure medium to the directional valve sections 56, 58, 60, 62 is connected to the pressure connection P. The outflow connection T lies on the outflow line 96 which is connected via the deflection 94 of the output section 64 to the control line 74 passing through the control block 4. Said control line can be connected to the inflow line 98 via a switching valve 124 and a flow-regulating valve 126.

As in the exemplary embodiment described above, the control oil volume flow in the control line 74 can be set via the flow-regulating valve 126. The switching valve 124 is acted upon the closing position by the load pressure in the LS line 26 and in the opening direction by the pressure in the control line 74 and the force of a comparatively weak spring.

Supply of control oil to the control line 74 accordingly takes place only when the load pressure is higher by the amount of the pressure equivalent of this spring than the control pressure in the control line 74 which is set when the cross sections of the respective OC directional valves 82 are throttled.

Figure 4A:
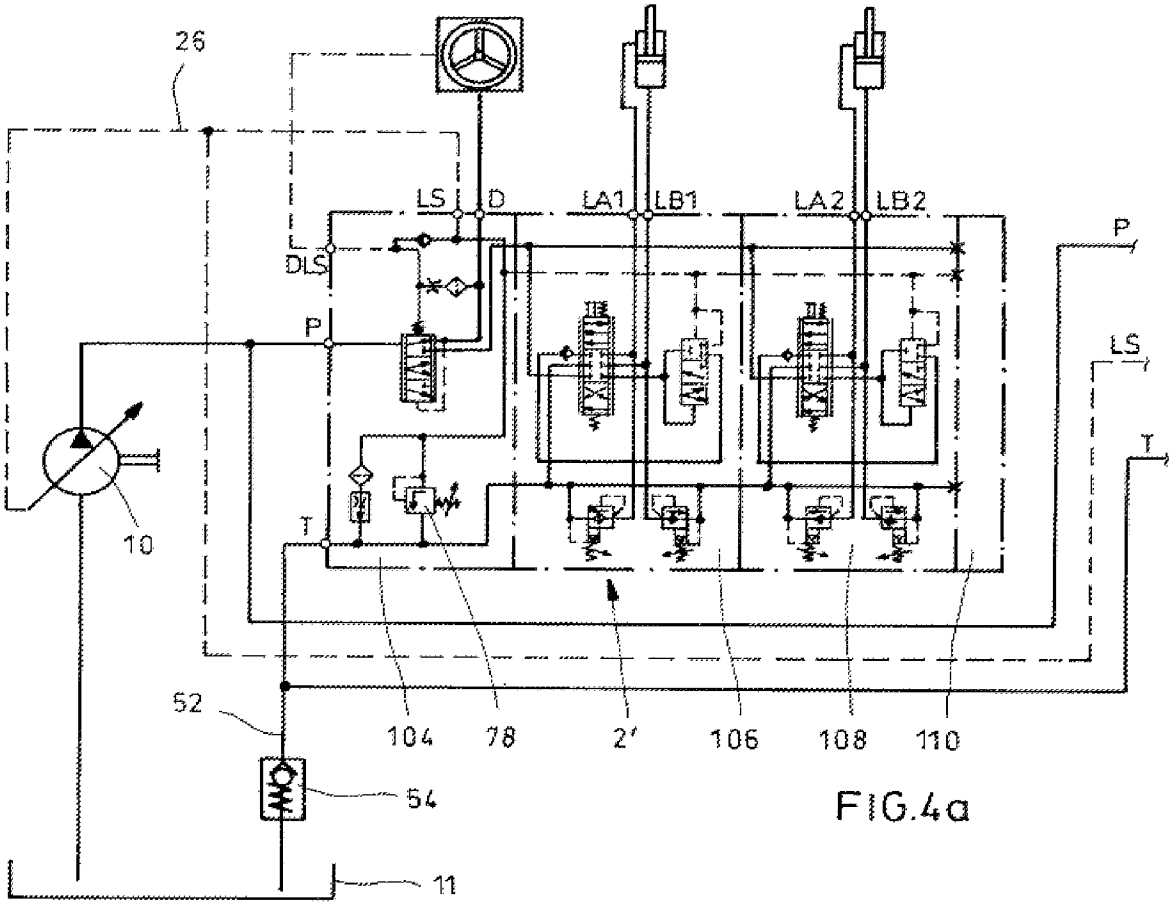
FIG. 4 shows a hydraulic control arrangement for supplying pressure medium to a dredger loader with an LUDV control block and a throttle control block.
Figure 4B:
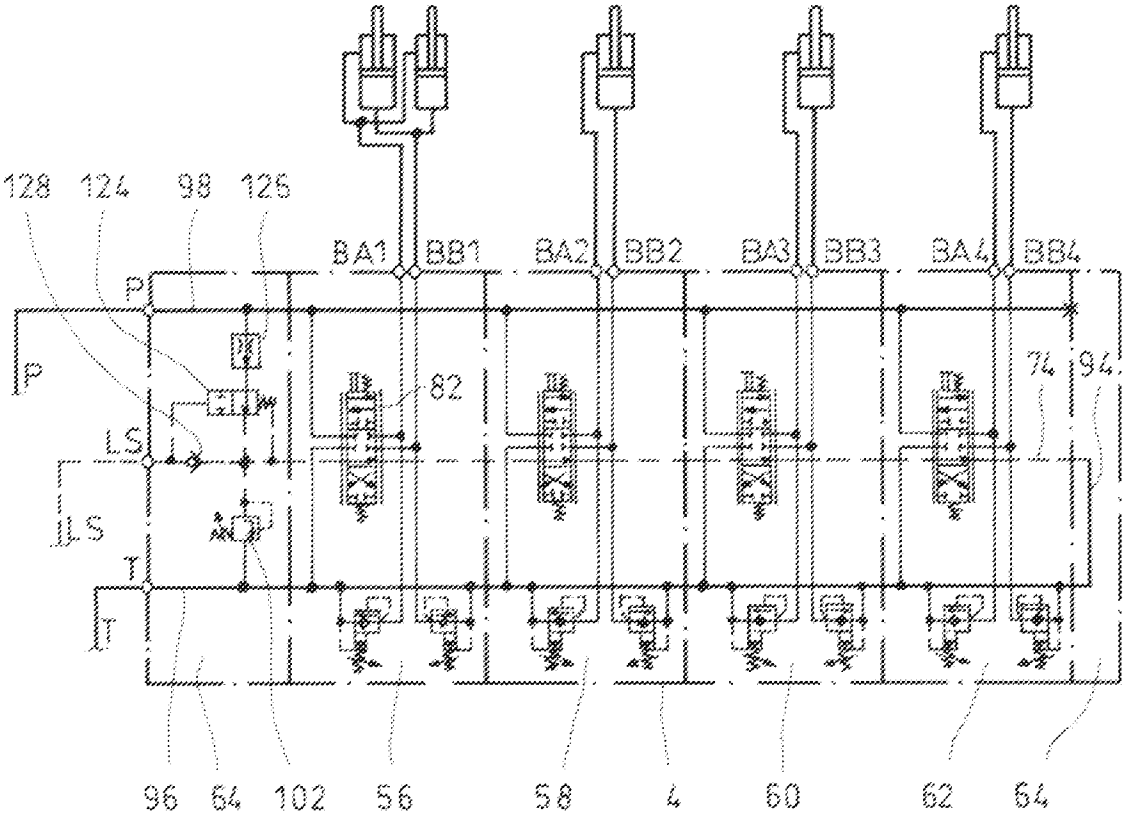

According to FIG. 4, the control line 74 can be connected to the LS line 26 via a non-return valve 128, this non-return valve 128 opening in the direction of the LS line 26 when the pressure in the control line 74 is higher than the load pressure in the LS line 26. That is to say, in this case, the higher control pressure in the throttle control block 4 is communicated to the pump-regulating unit 25 in the LS line 26 and the pump is adjusted according to this higher control pressure.

As in the exemplary embodiment described above, the pressure in the control line 74 is limited by the pressure-limiting valve 102 to a lower pressure level than in the LUDV control block 2'. The exemplary embodiment according to FIG. 4 otherwise corresponds to the exemplary embodiment according to FIG. 1, and therefore further explanations are unnecessary.

A hydraulic control arrangement for supplying pressure medium to two consumer groups via a common variable displacement pump is disclosed. According to the disclosure, the pressure level of a control block assigned to one consumer group is set at a pressure level other than that of a further control block assigned to the other consumer group.

The invention claimed is:

1. A hydraulic control arrangement, comprising:

a variable displacement pump configured to supply pressure medium to a first consumer group, to which a LUDV or LS control block is assigned, and to a second consumer group, to which a throttle control block is assigned, the variable displacement pump being adjustable as a function of a control pressure, wherein said throttle control block is configured in an open-center construction with a control line being connected to a tank in a basic position and being restricted in an actuated position, wherein the control pressure level in one of the control blocks is limited by a pressure-limiting valve, and wherein a pressure-limiting valve assigned to the other control block is configured to limit the control pressure level in said other control block to a value different from the pressure-limiting valve in said one of the control blocks, wherein the control blocks are connected in parallel with their control lines, wherein a control oil volume flow in the control line in the throttle control block is picked off via a flow-regulating valve from an inflow line carrying the pump pressure, and wherein the throttle control block is limited to a lower control pressure level and the LUDV or LS control block is limited to a higher control pressure level, the hydraulic control arrangement further comprising a switching valve located downstream of the flow regulating valve, the switching valve being acted upon in the closing direction by the control pressure in the LUDV or LS control block and in the opening direction by the control pressure in the throttle control block.

2. The control arrangement as claimed in claim 1, wherein the respective control lines of the control blocks are connected to one another via a non-return valve.

3. The control arrangement as claimed in claim 1, wherein the control block having the higher control pressure level is configured to supply a steering system via a priority valve.

4. The control arrangement as claimed in claim 3, wherein the variable displacement pump is activated as a function of the higher of the control/load pressures of the steering system, the LUDV or LS control block and the throttle second control block.

* * * * *